US006530176B1

(12) United States Patent
Hein

(10) Patent No.: US 6,530,176 B1
(45) Date of Patent: Mar. 11, 2003

(54) SYSTEM FOR LOCKING A SLIDING DOOR

(75) Inventor: Christian Hein, Langenhagen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 9 days.

(21) Appl. No.: 09/638,108

(22) Filed: Aug. 11, 2000

(30) Foreign Application Priority Data

Aug. 12, 1999 (DE) ..... 199 37 362

(51) Int. Cl.[7] ..... E05F 11/02
(52) U.S. Cl. ..... 49/279
(58) Field of Search ..... 49/279, 280, 281, 49/288, 289, 290, 291, 292, 293, 294, 295

(56) References Cited

U.S. PATENT DOCUMENTS

| | | | | | |
|---|---|---|---|---|---|
| 304,846 | A | * | 9/1884 | Moyer | |
| 308,645 | A | * | 12/1884 | White | |
| 344,271 | A | * | 6/1886 | Harris | |
| 398,706 | A | * | 2/1889 | Cox | |
| 460,711 | A | * | 10/1891 | Bright | |
| 935,206 | A | * | 9/1909 | Holdeman | |
| 1,154,782 | A | * | 9/1915 | Kotila | |
| 2,119,090 | A | | 5/1938 | Adam | |
| 4,142,326 | A | * | 3/1979 | Schmitz | 49/118 |
| 4,893,435 | A | * | 1/1990 | Shalit | 49/360 |
| 5,247,763 | A | * | 9/1993 | Hein | 49/31 |
| 6,079,162 | A | * | 6/2000 | Hein | 52/1 |

FOREIGN PATENT DOCUMENTS

| | | |
|---|---|---|
| DE | 4415708 | 7/1995 |
| DE | 4428718 | 2/1996 |
| DE | 19634390 | 3/1998 |
| FR | 2774720 | 8/1999 |
| WO | 9717519 | 5/1997 |

OTHER PUBLICATIONS

Eldor—Türautomatic GmbH—Massbild TORMAX T).
Automatische Schiebetürantriebe DORMA ES.

* cited by examiner

*Primary Examiner*—Daniel P. Stodola
*Assistant Examiner*—Khoa Tran
(74) *Attorney, Agent, or Firm*—Nils H. Ljungman & Associates

(57) ABSTRACT

A system for locking a driveable sliding door which comprises at least one moveable sliding panel and a swingable locking element which interlocks in its closed position with a first end with a lock pin. The system for locking is characterized by the second end of the swingable locking element being brought into contact with the sliding panel by opening or closing of the locking element so that the sliding panel can be driven into its opened or closed position.

12 Claims, 6 Drawing Sheets

SYSTEM FOR LOCKING A SLIDING DOOR

BACKGROUND OF THE INVENTION

1. Field of the Invention

The invention relates to a system for locking a driveable sliding door according to the upper portion of patent claim 1, which comprises at least one moveable sliding panel and a swingable locking element, which locking element interlocks in its closed position with a first,end with a lock pin.

2. Background Information

Locking arrangements for sliding doors are necessary for the reason that doors of this type can be securely locked without an additional lock in their closed position, in order that they can not opened using force, for example, after office hours. Locking arrangements have become known that, however, all need to be actuated by a separate drive, be it an electromagnetic drive, or a motor. In order to operate electrically actuated locking arrangements, additional switches or sensors or indicators are necessary which can give a signal to a control arrangement disposed downstream that the sliding panels are in their closed position. Systems that are equipped in this manner are comparably very expensive and, furthermore, the actuated components are subjected to wear, and they are generating considerable noise.

Furthermore, the operation of an electrically operated locking arrangement is not assured in the absence of power because the door panels can be opened.

An electromagnetic locking arrangement which can be made operative by means of a relay is illustrated in the technical data sheets of the firm ELDOR-Türautomatik GmbH. Such a locking arrangement assures that the two sliding panels of an electro-hydraulic drive unit for sliding doors are securely locked. The electro-mechanic drives that are illustrated in the data sheets for automatic sliding doors of the firm DORMA, ES55/60/70 also comprise electro-mechanic locking arrangements which are controlled by respective electronic controls.

These known locking arrangements for sliding doors have the drawback that costly components need to be provided and assembled, which require additional energy, and which cause noise.

The German Patent No. 44 15 708 C1 proposes, so as to alleviate the mentioned problems, a mechanical locking arrangement which is controlled by a drive belt for powering the individual sliding panels. This is done thereby that a driving piece is connected positively and non-positively to the revolving toothed drive belt, which driving piece is also connected to the carriage which needs to be moved by way of a guide element. In addition, a dog is provided at the driving piece, which dog interacts with a hook-shaped locking member. This dog moves over a release curve and, thus, lifts the rotatably journalled locking member from its locking position. The locking member is brought to its locking position by way of another member provided on the other end at the sliding panel that is driven in the opposite direction, such that on joining of the two door panels a locking of the panels is achieved thereby that by means of a run-in device of the driving piece, and thereby the upper portion of the drive belt is pushed downwards, which provides for movement of the locking member. A stop is provided between the two ends of the carriages, which stop is connected to the abutment, and which stop ensures that, despite the locked condition, the two door panels can not be moved out of the locked condition. When opening the sliding panels, the drive motor is started and pulls at the drive belt. Due to the configuration of the driving piece which comprises an angular recess in which is guided a follower pin, the drive belt is carrying out a quasi empty run and, thus, provides that the locking member is moved from its locking position. When the locking member has released the locking engagement with the second sliding panel, carrying along of the carriage can be done without difficulties. While this principle of solving operational problems according to German Patent No. 44 15 708 C1 is affording a well-functioning system, and it is simple in comparison to the earlier mentioned arrangements, it, nevertheless, requires a substantial amount of components.

OBJECT OF THE INVENTION

It is the object of the invention, accordingly, to provide a further simplified and yet more economic locking system, without the need of costly components and assembly thereof, and which system can also be actuated by means of an auxiliary drive.

SUMMARY OF THE INVENTION

The invention provides in the type of system locking for a solution thereby that the second end of the swingable locking element can be brought to be in contact with the sliding panel, such that opening or closing of the locking element effects the displacement of the sliding panel into its opened or closed position.

Further features of the invention are contained in the dependent claims.

Due to the fact that the locking element imparts a transfer of the motions during opening and closing, without the use of additional components, to the sliding panel, there is achieved a very simple construction assembly which leads, aside from a lowering in cost, also to a rather simple assembly of and maintenance for the locking system and the sliding door in accordance with the invention. In addition, the locking system in accordance with the invention can be used as a kit to retrofit installations and to replace the hitherto known and expensive locking arrangements and, accordingly, can reduce the maintenance cost of such sliding doors with locking arrangement.

Preferably, the locking system and sliding door of the invention make use of a drive belt to drive the assembly which means that a hitherto known element is being utilized.

In accordance with a preferred embodiment of the present invention, there is connected a connecting part at the drive belt, and this connecting part interacts with the second end of the locking element in such a way that operation of the drive belt into the opening and closing position of the sliding panel effects a swinging movement of the locking element into its opening and closing position. Hereby it is ensured, without additional components, in a simple manner, that the locking element is positioned in the correct attitude, i.e., in opening and closing position, in conformity with the drive direction of the drive belt.

So as to achieve a direct transfer of the movement of the drive belt from the locking element to the sliding panel on one hand and, as well, to ensure the correct position of the locking element during the respective movement, there are provided two stops which are disposed at a distance from one another at the sliding panel, and these two stops interact with the second end of the locking element, in such a way that actuation of the drive belt is transferred, via the connecting part, to the second end of the locking element and thence to the two stops of the sliding panel.

In this respect it is of advantage that the locking element is configured as a substantially rectangular locking lever and that the vertex of the rectangular locking lever is rotatably journalled at the sliding panel. This provides for the utilization of a simple and economic locking lever which, on the other hand, can transmit, due to its lever arm proportions, even small forces in suitable manner.

In accordance with a preferred embodiment of the invention, a guide lever is rotatably journalled at the sliding panel, and this guide lever interacts with a deflector, such that the locking element is positively brought into the closing position. This guide lever, in conjunction with a deflector, ensures that the locking element, even with large manufacturing and assembly tolerances being present, nevertheless, affords a positive interlocking of the locking element at the lock pin, i.e., no unintentional interaction occurs during the locking process between the two components, such that opening of the sliding panel is no longer possible.

In this embodiment the guide lever is preferably configured with a crank-type formation into which engages a pin of the locking element or, in other words, which affords an adequate guiding of the locking element, via the pin in the crank-type formation, during the closing and opening process.

As further preferred embodiment has been found the option to configure the guide lever with a-ramp bevel at its end directed towards the deflector.

Since the system for locking of a driveable sliding door needs to be available for escape and emergency doors, such systems need to be operable with manual operation in the event of a power outage, or an auxiliary drive needs to be present for functionality. In the above-mentioned reference this is not an available option because the movements of the sliding panel and the actuation of the locking arrangement are achieved by the motor-driven drive belt. In order to overcome this problem, the locking system in accordance with the present invention has an auxiliary drive. By means of this, the locking system in accordance with the invention can be operated either with a controllable clutch, or without a clutch and the auxiliary drive, and with an associated movement of the drive belt, to assume the open position, and the sliding panel can subsequently be moved into its open position.

In this context it has been found advantageous to configure the auxiliary drive as a spring or rubber rope which are biased to bring the sliding panel to its open position.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENT

Figure 1:
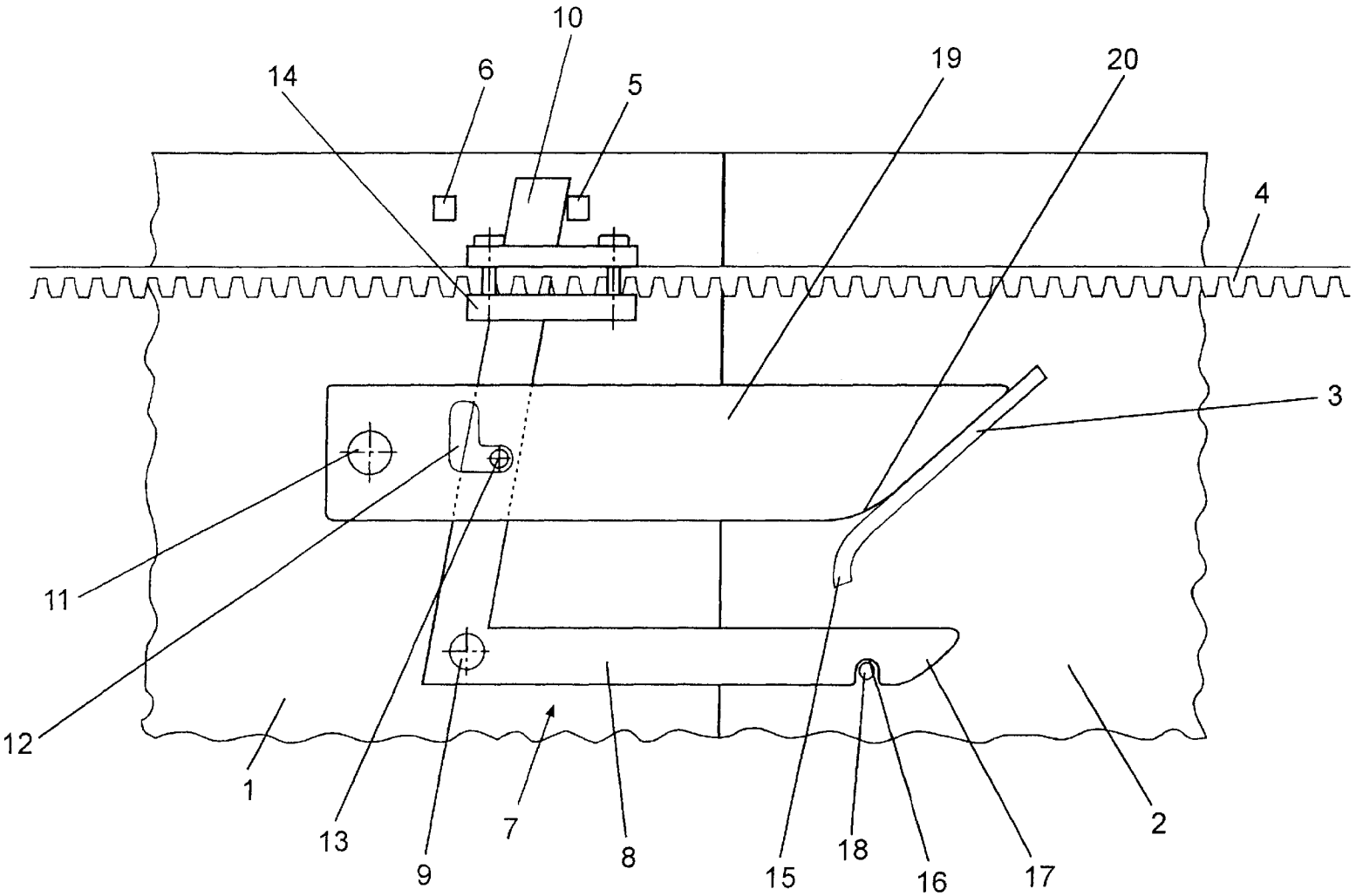
FIG. 1 is an elevational view of two sliding panels illustrating a locked condition of a locking system with a locking arm of a locking lever being in an engaged position according to at least one embodiment of the invention.

FIG. 1 represents the closed position of the locking or locking system in accordance with the invention. In this, the two sliding panels 1,2 are in contact with one another. The left sliding panel in FIG. 1 is indirectly connected to a drive belt 4 with a connecting part 14. While not shown, also the right sliding panel is connected to the endless drive belt 4 by a connecting part such that in conformity with the drive direction of the drive belt 4 the two sliding panels move away from one another or move towards one another.

The sliding panel 1 has two stops 5, 6 positioned at a distance from one another and between which is journalled one end of the lever arm 10 of the locking lever 7. The lever arm 7, in turn, is journalled so as to be swingable relative to the sliding door 1 by means of a pin 9 which is positively connected to the sliding panel 1. In this, the pin 9 is positioned substantially at the vertex of the substantially rectangular locking lever 7.

The second lever arm 8 of the locking lever 7 has a recess 16 at its end portion, which recess engages a lock pin 18 in the locked condition of the locking system, which locking pin is secured at the second sliding panel 2. Furthermore, the second lever arm 8 is configured at its end with a ramp bevel 17 which serves as guide surface for the lock pin 18 during the closing process, as will be described in greater detail below.

The first lever arm 10 of the locking lever 7 is configured, as is illustrated in FIG. 1, also with a crank pin 13 which interacts with the crank-type formation 12 of a lever 19. The lever 19, in turn, is journalled for rotation about a pin as center of rotation 11 at the first sliding panel 1. In addition, the lever 19 comprises, at its end which is directed towards the second sliding panel 2, a slide surface 20 which, during the closing process between the first and second sliding panel 1,2, interacts with a deflector 3 which is connected at the second sliding panel 2. The deflector 3, in the illustration of FIG. 1, comprises at its lower end a rounded portion 15.

In the following is described, on the basis of FIGS. 1 to 3, the operation of the above-mentioned components, respectively, during the opening process of the locking system in accordance with the present invention, as well as that of the two sliding panels.

Figure 2:
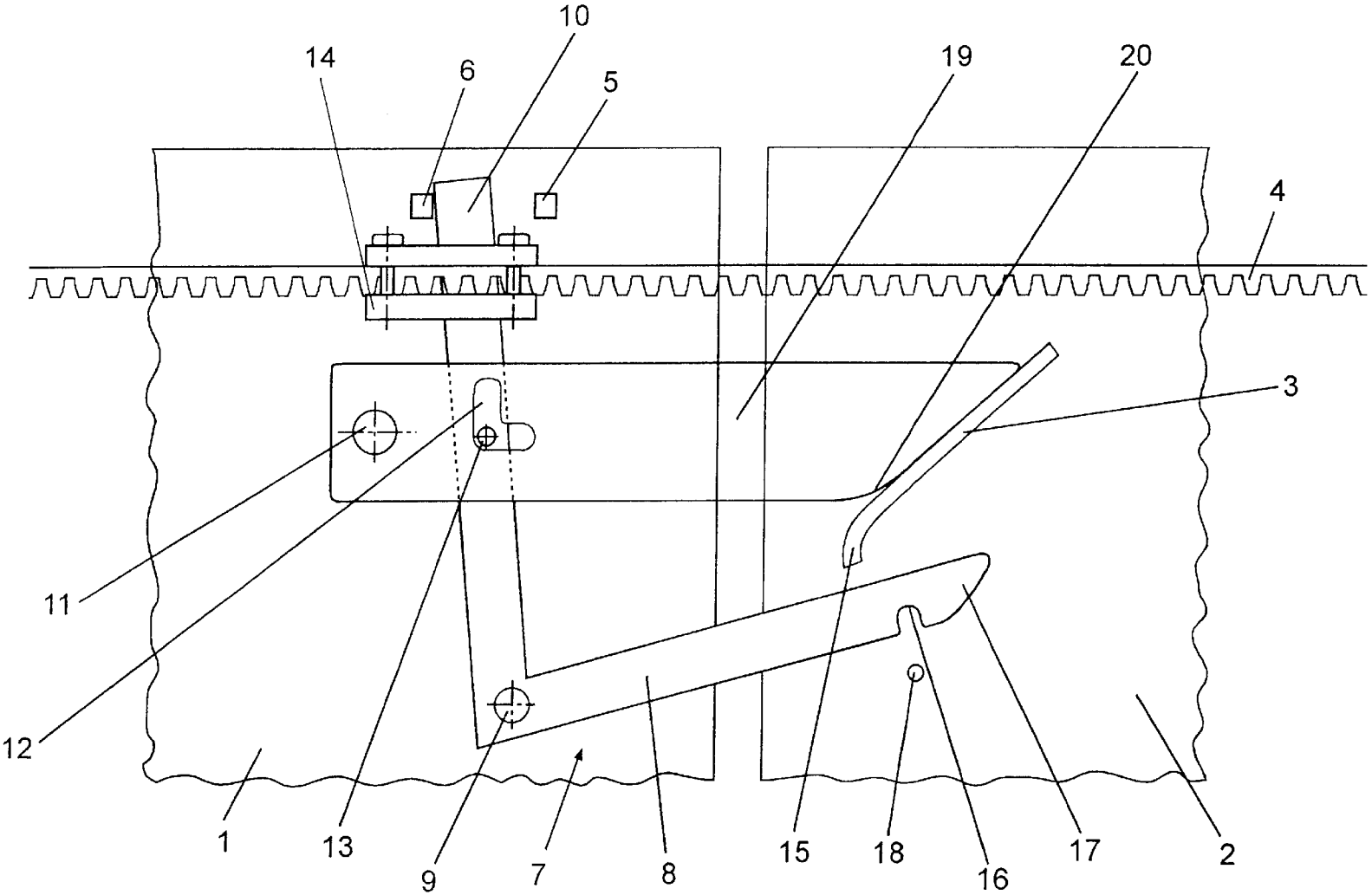
FIG. 2 shows the locking system of FIG. 1 with the locking arm in a disengaged or released position according to at least one embodiment of the present invention.
Figure 3:
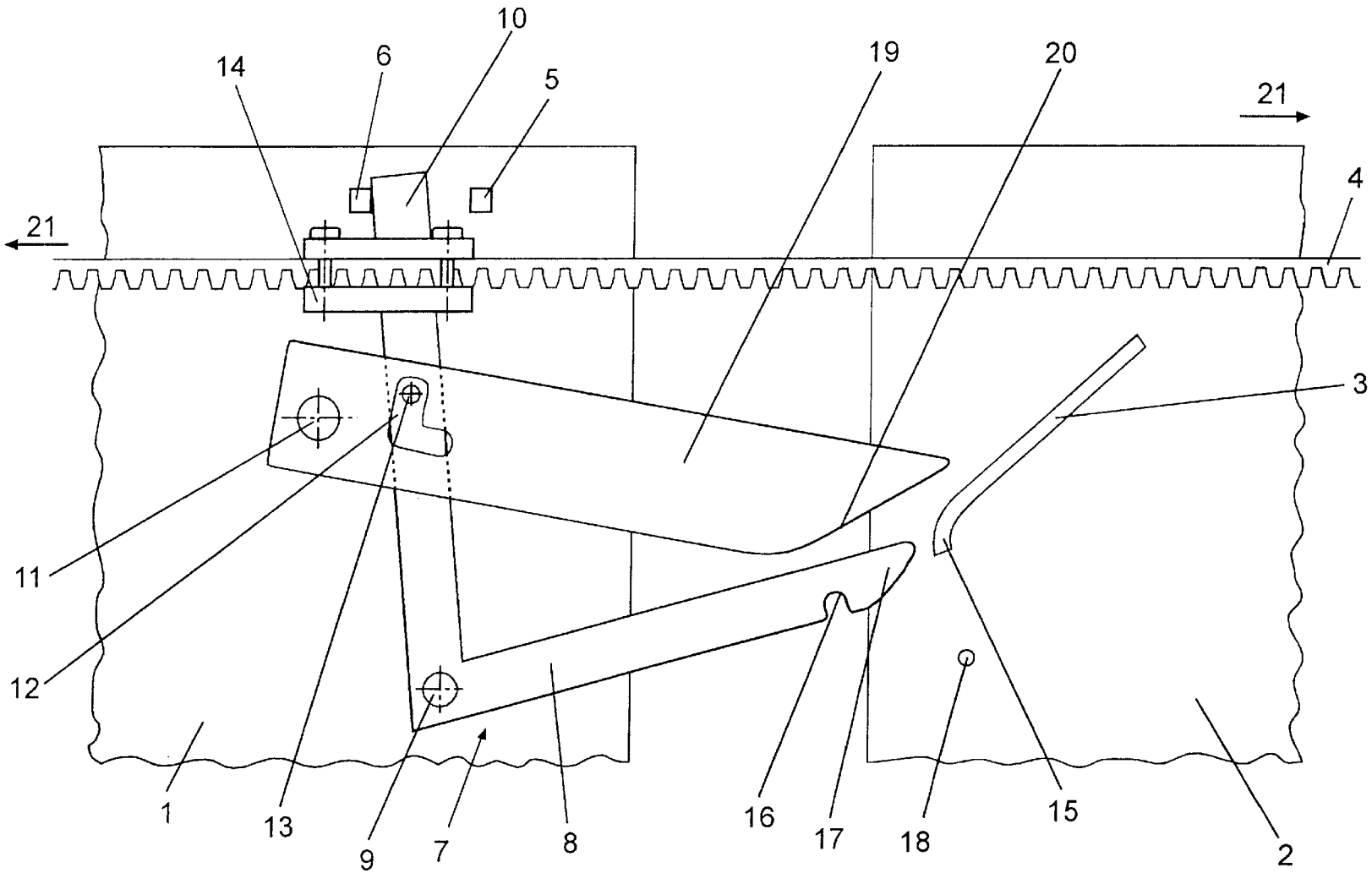
FIG. 3 shows the locking system of FIG. 1 with the locking arm in a further disengaged or released position according to at least one embodiment of the present invention.

Beginning with FIG. 1, in which is illustrated that the sliding panels 1,2 and the locking system in accordance with the invention are in their closed position, now the drive belt 4 is driven into the opening direction 21, as indicated in FIGS. 1 to 3. Due to this step, the connecting part 14 that is secured at the drive belt 4 contacts with its right lateral portion the lever arm 10, although not shown, and causes the lever 7 to swing, during a further movement illustrated in FIGS. 1 to 3, about the pin or center of rotation 9 to the left, such that the recess 16 of the lever arm 8 as well as the lock pin 18 are being disengaged. During a further movement of the drive belt 8 in the opening direction 21 also the crank pin 13 shifts in the horizontal leg, according to FIGS. 1 and 2, of the crank-type formation 12 to the left, and the lever arm 10 contacts the stop 6 of the sliding panel 1. The contacting of lever arm 10 and stop 6 of the sliding panel 1, on one hand, and of the connecting part 14 and the lever 10, on the other hand, through further driving motion of the drive belt 4, such as through a motor drive, causes that the sliding panel 1 is moved, according to FIGS. 1 to 3, to the left, into its opening position. While not shown, of course, in the reverse process, also the sliding panel 2, via its connection with the endless drive belt 4, is driven, according to FIGS. 1 to 3, into its opening position.

As is evident from FIG. 3, during a further separation of the two sliding panels 1,2, the slide surface 20 of the lever 19 slides along the deflector 3, according to FIG. 3, in downward direction and, accordingly, carries out a swinging movement about the point of rotation 11. In this, the swing movement, according to FIG. 3 in downward direction, is limited by the interaction between the crank pin 13 and the substantially vertical leg of the crank-type formation 12.

FIG. 3, accordingly, illustrates the final position of the components of the locking or locking system in accordance with the invention in the opening process.

Figure 4:
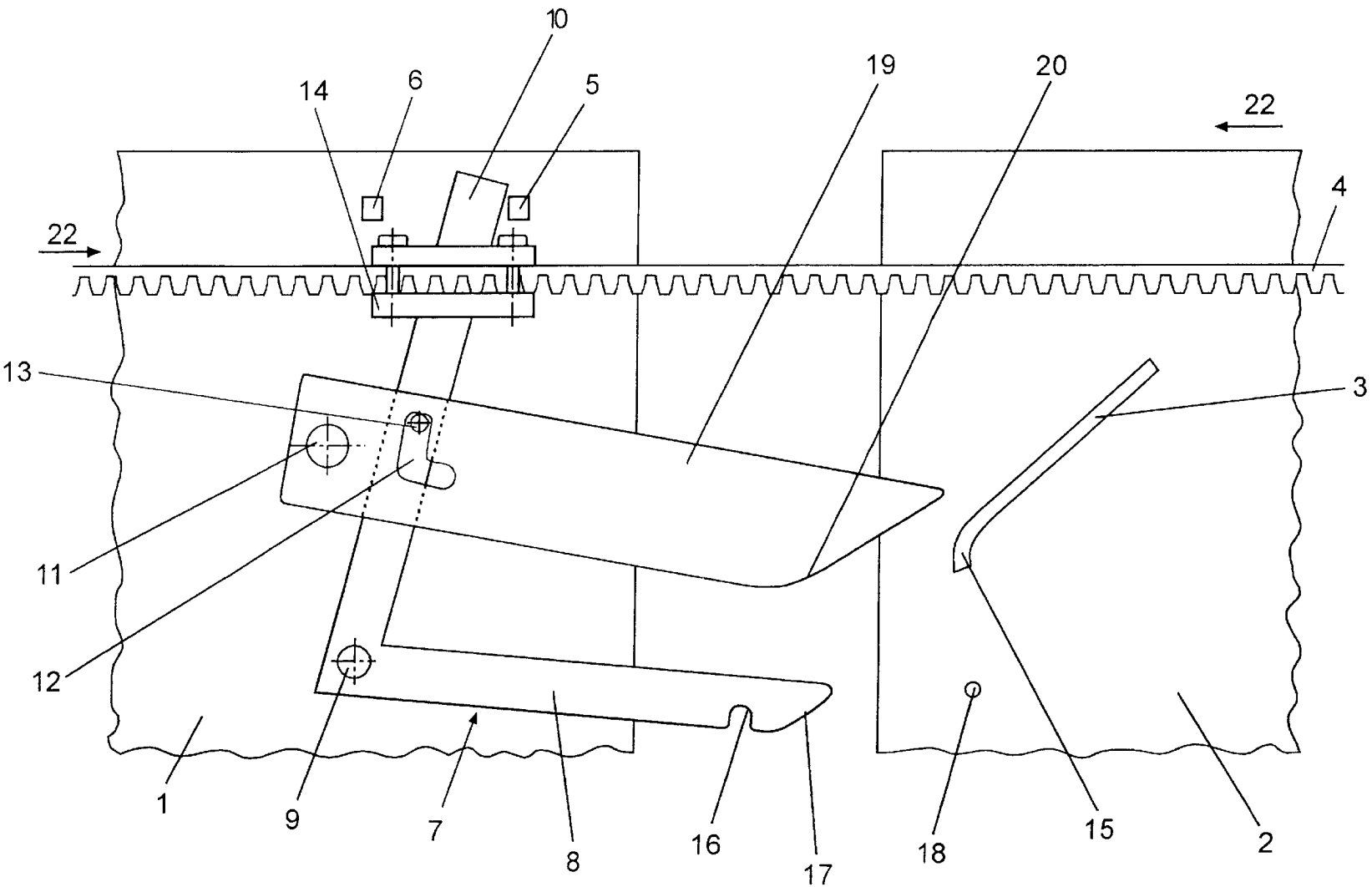
FIG. 4 is an elevational view similar to FIG. 1 and illustrating the components of the locking system while moving the sliding panel into the closed position.

In FIG. 4 is yet shown the position of the components of the locking system according to the invention during movement of the drive belt 4 into the closing position 22. In this, in contrast to FIG. 3, the locking lever 7 was swung about the point of rotation 9, through the interaction with the connecting part 14 to the right, and contacts the stop 5 of the sliding panel 1 during the closing sequence. On further driving motion of the drive belt 4 into the closing position of the two sliding panels 1 and the locking system in accordance with the invention, first the slide surface 20 of the lever 19 and, as well, the deflector 3 are contacting one another. Because of this, in turn, the lever 19 is moved from its downwardly directed position in FIG. 4 into an approximately horizontal position during the closed position—compare FIG. 1. By means of this swing movement carried out by the lever 19, there is effected, of course, by means of the interaction between the crank pin 13 of the locking lever 7 and the crank-type formation 12 of the lever 19, a slight swing movement of the locking lever 7 about the point of rotation 9, such that on further convergence of the sliding panels 1 and 2 towards one another, the ramp bevel 17 contacts the lock pin 18 and, finally, the lock pin 18 is latching into the recess 16 of the locking lever 7.

While not shown, both the sliding panels 1,2 and, as well, only one sliding panel can comprise an auxiliary drive such that in an emergency, for example, a fire, and an attendant loss of electricity, the sliding panels can be driven into their open position. A spring or a rubber rope have been found particularly advantageous as auxiliary drive, which two components are disposed to provide that the sliding panels are being biased into the open position. In the event of a loss of the electrical power supply, it is now still possible, by means of the pre-tensioning of a spring or of a rubber rope to open the sliding panels 1,2 and the locking system in accordance with the invention.

The provision of a pre-tension force delivers an additional advantage, also during operation of the system in accordance with the invention with a drive belt 4 and associated drive motor. Because of the fact that by means of the pre-tension force—which is directed in the direction opposite the closing direction 21—the spring or rubber rope serving as auxiliary drive, the drive belt 4 is capable, during a start-up phase, to carry out a quasi empty drive phase for a certain length of travel. This means that the sliding panels 1 and 2 remain in their closed position, based on the locked position according to FIG. 1. However, during this empty drive phase of the drive belt 4, the locking lever 7 is already being swung from its closed position into the open position, such that the two sliding panels 1,2, on transmission of the opening movement from the drive belt 4 to the sliding panels 1,2, can be directly brought to the open sequence without an interaction between the recess 16 and the lock pin 18. This entails utilization of the elasticity of the dive belt 4.

Aside from the above-described application for a double panel door it is also possible to utilize the system of the invention in the case of single panel doors. In such a system one only needs to secure the lock pin 18 and the deflector 3 at a fixed component which is directed towards the sliding panel 1.

Figure 5:
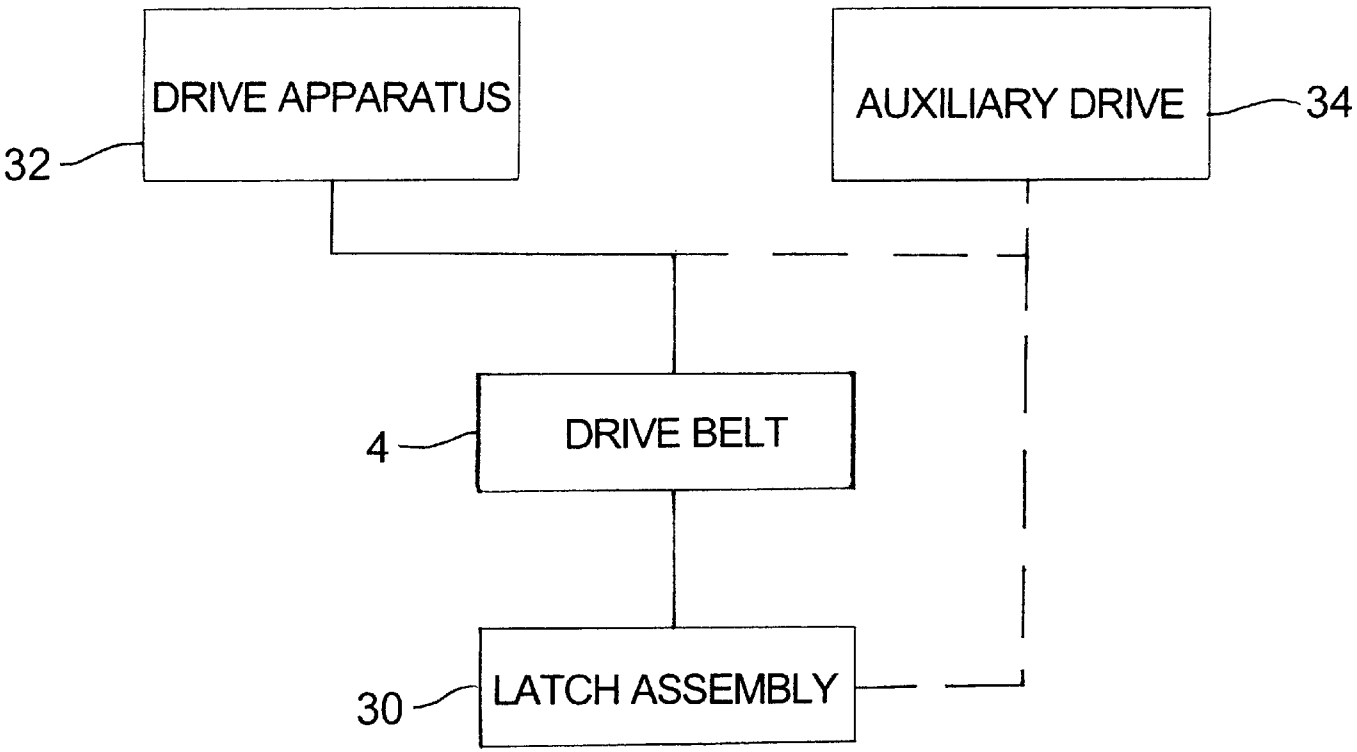
FIG. 5 is a schematic diagram showing details of drive apparatus according to at least one embodiment of the present invention.
Figure 6:
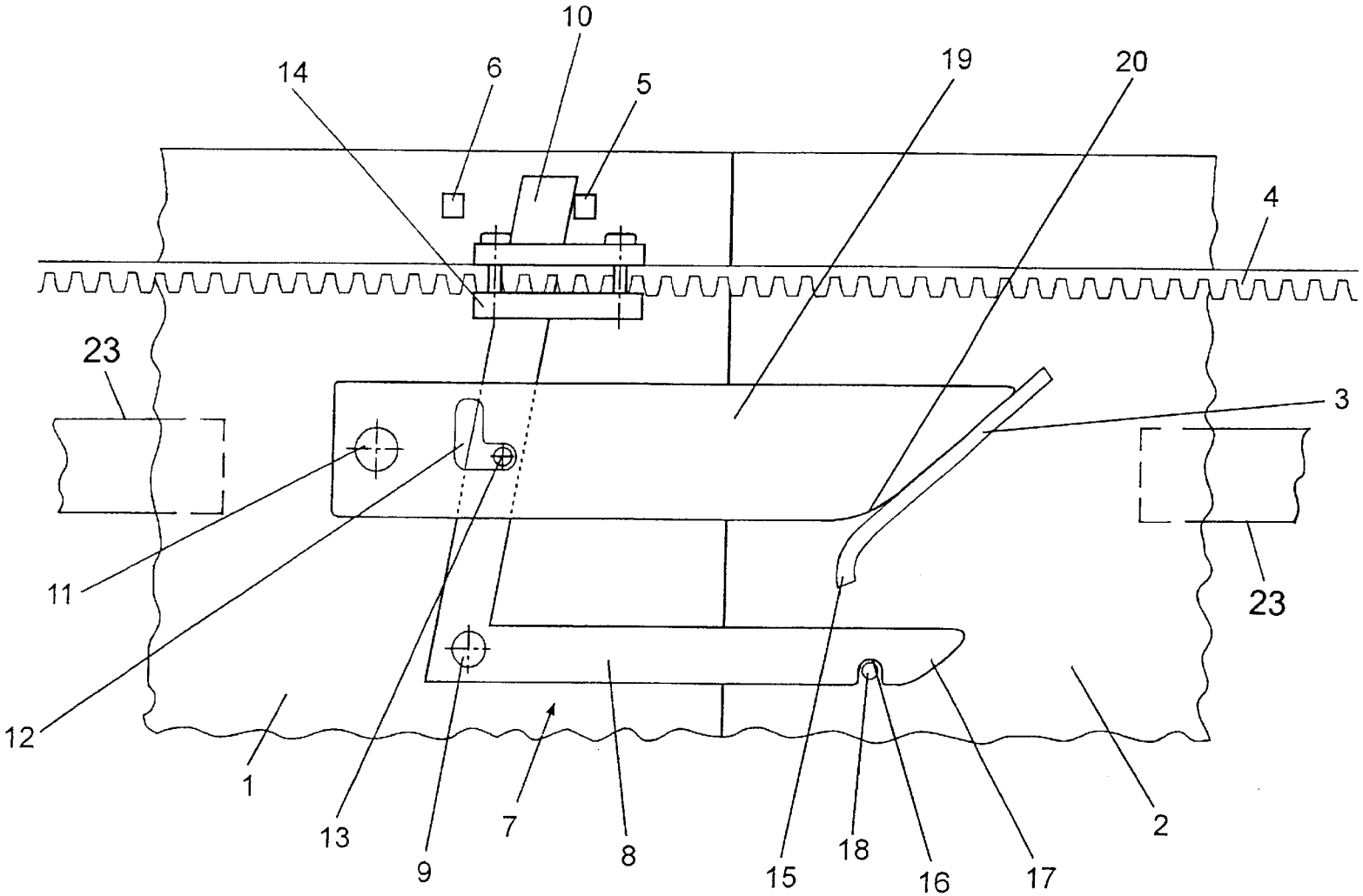
FIG. 6 is another view of the locking mechanism as shown in FIG. 1 with additional features according to at least one embodiment of the present invention.

FIG. 5 is a schematic diagram showing details of drive apparatus according to at least one embodiment of the present invention; and FIG. 6 is another view of the locking mechanism as shown in FIG. 1 with additional features according to at least one embodiment of the present invention.

In other words, the door leafs or panels 1 and 2 may be closed and thereby can tension a spring or rubber belt or band so that, in an emergency, the latch assembly 30 will be disengaged and the leafs 1 and 2 can be opened with respect to one another under the influence of the spring or elastic belt by moving at least one door leaf or panel 1 or 2 by a handle apparatus 23. This possibility is generally indicated through an auxiliary drive 34 shown in the schematic diagram in FIG. 5.

FIG. 6 is another view of the locking mechanism as shown in FIG. 1 showing the handle apparatus 23, according to at least one embodiment of the present invention.

While a toothed belt 4 has been illustrated to be driven by a drive apparatus 32, it is to be understood that other drive arrangements are, of course, possible at least one additional embodiment of the present invention.

Examples of toothed belts which may be used in embodiments of the present invention may be found in the following U.S. patents: U.S. Pat. No. 5,178,586 issued on Jan. 12, 1993 to Mizuno and entitled "Toothed belt"; U.S. Pat. No. 5,181,889 issued on Jan. 26, 1993 to Maruyama, et al. and entitled "Tensioner for a toothed belt"; U.S. Pat. No. 5,184,352 issued on Feb. 9, 1993 to Manfette and entitled "Molded plastic belt with integrated locking mechanism"; U.S. Pat. No. 5,209,961 issued on May 11, 1993 to Yukoi and entitled "Toothed belt"; U.S. Pat. No. 5,234,387 issued on Aug." 10, 1993 to Fujiwara, et al. and entitled " Toothed belt and method for producing the same"; U.S. Pat. No. 5,306,213 issued on Apr. 26, 1994 to Nakajima, et al. and entitled " Toothed belt"; U.S. Pat. No. 5,322,479 issued on Jun. 21, 1994 to Devehat and entitled A Endless belt power transmission system"; and U.S. Pat. No. 5,342,252 issued on Aug. 30, 1994 to Fujiwara, et al. and entitled "Toothed belt".

Examples of linear motor devices which may be used in embodiments of the present invention may be found in the following U.S. Pat. No. 5,416,397 issued on May 16, 1995 to Mazzara, et al. and entitled "Linear motor control system and method of use"; U.S. Pat. No. 5,691,613 issued on Nov. 25, 1997 to Gutwillinger and entitled "Method for determining a motor position of a rotary motor or linear motor, and circuit arrangement for carrying out the method"; U.S. Pat. No. 5,742,136 issued on Apr. 21, 1998 to Ono, et al. and entitled "Linear motor drive system"; U.S. Pat. No. 5,825,104 issued on Oct. 20, 1998 to Kondo, et al. and entitled "Small linear motor table"; U.S. Pat. No. 5,998,890 issued Dec. 7, 1999 to Sedgewick, et al. and entitled "Linear motor with improved coil design and heat removal"; and U.S. Pat. No. 6,064,128 issued on May 16, 2000 to Yagoto, et al. and entitled "Linear motor and image reader".

Examples of limit switch devices which may be used with drive systems in embodiments of the present invention may be found in the following U.S. Pat. No. 4,943,715 issued on Jul. 24, 1990 to Konishi and entitled "Limit switch having means to evaluate its actuating stroke"; U.S. Pat. No. 5,207,316 issued on May 4, 1993 to Sakamoto and entitled "Limit switch"; U.S. Pat. No. 5,227,965 issued on Jul. 13, 1993 to Klaes, et al. and entitled "Fast programmable limit switch"; U.S. Pat. No. 5,430,264 issued on Jul. 4, 1995 to Shinohara, et al. and entitled "Limit switch"; and U.S. Pat. No. 5,890,585 issued on Apr. 6, 1999 to Nakamura, et al. and entitled "Limit switch mounting structure for a linear actuator".

Examples of locking transmissions which may be used in embodiments of the present invention may be found in the following U.S. Pat. No. 5,251,723 issued on Oct. 12, 1993 to Rolinski, et al. and entitled "Service brake and shift lever interlock system"; U.S. Pat. No. 5,199,288 issued on Apr. 6, 1993 to Merilainen, et al. and entitled "Electromechanical door lock"; U.S. Pat. No. 5,431,244 issued on Jul. 11, 1995 to Possobom and entitled "Anti-theft shift lock for vehicle"; U.S. Pat. No. 5,431,266 issued on Jul. 11, 1995 to Ito, et al. and entitled "Shift lock system"; U.S. Pat. No. 5,388,674 issued on Feb. 14, 1995 to Severinsson and entitled "Device in a brake unit"; and U.S. Pat. No. 5,383,541 issued on Jan. 24, 1995 to Kaplan and entitled "Automatic gear shift lock".

Examples of brakes and electromagnetic brakes which may be used in embodiments of the drive system for the present invention may be found in the following U.S. Pat. No. 5,185,542 issued on Feb. 9, 1993 to Lazorchak and entitled "Electromagnetic pulse operated bi-stable brake"; U.S. Pat. No. 5,186,286 issued on Feb. 16, 1993 to Lindberg and entitled "Electromagnetic brake"; U.S. Pat. No. 5,234,083 issued on Aug. 10, 1993 to Lee and entitled "Magnetic brake"; and U.S. Pat. No. 5,275,261 issued on Jan. 4, 1994 to Vranish and entitled "Electromagnetic brake/clutch device".

Examples of chain drives which may be used in embodiments of the drive system or apparatus for the present invention may be found in the following U.S. Pat. No. 4,759,740 issued on Jul. 26,1989 to Cradduck and entitled "Dual engaging silent chain drive"; U.S. Pat. No. 4,878,883 issued on Nov. 7, 1989 to Wheless and entitled "Continuously variable chain drive transmission"; U.S. Pat. No. 5,165,574 issued on Oct. 20, 1992 to Gai and entitled "Powerassisted chain drive actuator for opening and closing gating fixtures"; U.S. Pat. No. 5,362,279 issued on Nov. 8, 1994 to Galchefski and entitled "Self-tensioning chain drive"; U.S. Pat. No. 5,427,582 issued on Jun. 27, 1995 to Iwao, et al and entitled "Chain drive device"; and U.S. Pat. No. 5,927,690 issued on Jul. 27, 1999 to White et al. and entitled "Push-pull chain drive door operator system".

Some examples of guide rails or systems for door, wall, or partition systems that possibly may be utilized or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828, issued to inventor Matimura on Dec. 3, 1985; and U.S. Pat. No. 4,084,289, issued to inventor Naimo on Apr. 18, 1978.

Some examples of doors, foldable doors, or door systems and mechanisms and devices for their operation that possibly may be utilized or incorporated in at least one possible embodiment of the present invention may be .found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455, issued to inventor Yamada on Jun. 12, 1990.

Some examples of movable partition or wall systems and devices for their operation that possibly may be utilized or incorporated in at least one possible embodiment of the present invention may be found in the following U.S. Pat. No. 5,730,027, issued to inventor Hormann on Mar. 24, 1998; U.S. Pat. No. 5,461,829, issued to inventors Lehto et al. on Oct. 31, 1995; U.S. Pat. No. 5,404,675, issued to inventor Schmidhauser on Apr. 11, 1995; U.S. Pat. No. 5,329,857, issued to inventor Owens on Jul. 19, 1994; U.S. Pat. No. 5,295,281, issued to inventor Kordes on Mar. 22, 1994; U.S. Pat. No. 5,394,648, issued to inventor Kordes on Mar. 7, 1995; U.S. Pat. No. 5,417,013, issued to inventor Tillmann on May 23, 1995; U.S. Pat. No. 5,544,462, issued to inventor Kordes on Aug. 13, 1996; U.S. Pat. No. 5,406,761, issued to inventors Hobbiebrunken et al. on Apr. 18, 1995; U.S. Pat. No. 5,152,332, issued to inventor Siener on Oct. 6, 1992; U.S. Pat. No. 5,042,555, issued to inventor Owens on Aug. 27, 1991; U.S. Pat. No. 4,934,119, issued to inventor Ybarra on Jun. 19, 1990; U.S. Pat. No. 4,914,878, issued to inventors Tarnaki et al. on Apr. 10, 1990: U.S. Pat. No. 4,895,246, issued to inventor Rizzi on-Jan. 23, 1990; U.S. Pat. No. 4,752,987, issued to inventors Dreyer et al. on Jun. 28, 1988; U.S. Pat. No. 4,596,094, issued to inventors Teller et al. on Jun. 24, 1986; U.S. Pat. No. 4,555,828, issued to inventor Matimura on Dec. 3, 1985; U.S. Pat. No. 4,458,462, issued to inventor Schold on Jul. 10, 1984; U.S. Pat. No. 4,404,770, issued to inventor Markus on Sep. 20, 1983; and U.S. Pat. No. 4,112,647, issued to inventor Scheid on Sep. 12, 1978.

Some examples of locking mechanisms for sliding door or partition systems that possibly may be utilized or incorporated in at least one possible embodiment of the present invention may be found in the following U.S. patents: U.S. Pat. No. 6,053,547, issued to inventor Lemieux on Apr. 25, 2000; U.S. Pat. No. 6,050,617, issued to inventors Prevot, et al. on Apr. 18, 2000; U.S. Pat. No. 6,035,673, issued to inventor Harrison on Mar. 14, 2000; U.S. Pat. No. 6,032,987 issued to inventors Fukumoto, et al. on Mar. 7, 2000; U.S. Pat. No. 6,000,735, issued to inventor Jourdenais on Dec. 14, 1999; U.S. Pat. No. 6,000,734, issued to inventors Prevot, et al. on Dec. 14, 1999; U.S. Pat. No. 5,951,068, issued to inventors Strong, et al. on Sep. 14, 1999; U.S. Pat. No. 5,934,719, issued to inventor Athanasios on Aug. 10, 1999; U.S. Pat. No. 5,918,915, issued to inventor Calteux on Jul. 6, 1999; U.S. Pat. No. 5,906,403, issued to inventors Bestler, et al. on May 25, 1999; U.S. Pat. No. 5,594,283, issued to inventors Bartel, et al. on Jan. 14, 1997; U.S. Pat. No. 5,561,994, issued to inventors Smith, et al. on Oct. 8, 1996; and U.S. Pat. No. 5,542,720, issued to inventor Fleming on Aug. 6, 1996.

Some examples of drives or electromechanical or electro-hydraulic drives that possibly may be utilized or incorporated in at least one possible embodiment of the present invention may be found in the following U.S. patents: U.S. Pat. No. 5,666,268, issued to inventors Rix et al. on Sep. 9, 1997; U.S. Pat. No. 5,386,885, issued to inventors Bunzl et al. on Feb. 7, 1995; U.S. Pat. No. 5,521,400, issued to inventor Schultze on Oct. 12, 1993; U.S. Pat. No. 5,080,.635, issued to inventors Martinez et al. on Jan. 14, 1992; U.S. Pat. No. 4,501,090, issued to inventors Yoshida et al. on Feb. 26, 1985; and U.S. Pat. No. 4,430,846, issued to inventors Presleyet al. on Feb. 14, 1984.

Some examples of guides, rollers, guide elements, or guide arrangements that possibly may be used in at least one possible embodiment of the present invention may be found in the following U.S. patents: U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987; U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977.

Some examples of door closers that possibly may be utilized or incorporated in at least one possible embodiment of the present invention may be found in the following U.S. Pat. No. 5,832,561, issued to inventor Bienek on Nov. 10, 1998; U.S. Pat. No. 5,802,670, issued to inventor Bienek on Sep. 8, 1998; U.S. Pat. No. 5,770,934, issued to inventor Theile on Jun. 23, 1998; U.S. Pat. No. 5,651,216, issued to inventor Tillmann on Jul. 29, 1997; U.S. Pat. No. 5,428,278, issued to inventors Bollengier et al. on Jun. 27, 1995; U.S. Pat. No. 5,417,013, issued to inventor Tillmann on May 23, 1995; U.S. Pat. No. 5,251,400, issued to inventor Schultze on Oct. 12, 1993; U.S. Pat. No. 4,669,147, issued to inventor Suchanek on Jun. 2, 1987; U.S. Pat. No. 4,501,090, issued to inventors Yoshida et al. on Feb. 26, 1985; U.S. Pat. No. 4,419,787, issued to inventor Lieberman on Dec. 13, 1983; and U.S. Pat. No. 4,285,094, issued to inventor Levings, Jr. on Aug. 25, 1981.

Some further examples of door closers that possibly may be utilized or incorporated in a possible embodiment of the present invention may be found in the advertising brochure, entitled "Das Programm", for the company DORMA GmbH + Co. KG, Postfach 4009, D-58247 Ennepetal, Federal Republic of Germany, which advertising brochure bears the following identifying information: WN 051307, 12/96, Programm, D, 10, STB, 2/97, Atelier G. Heinz, Velbert, which advertising brochure describes, for example, on page 25, the door closer or drive system named the "DORMA ED 200".

Some examples of devices or transmissions that possibly may be utilized or incorporated in at least one possible embodiment of the present invention may be found in the following U.S. Pat. No. 4,763,385, issued to inventors Furch et al. on Aug. 16, 1988, and U.S. Pat. No. 4,744,125, issued to inventors Scheck et al. on May 17, 1988.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The following patents, patent applications, or patent publications are hereby incorporated by reference as if set forth in their entirety herein as follows: U.S. application Ser. No. 09/473,620, filed on Dec. 29, 1999 by inventor Janutta, now a U.S. Pat. No. 6,313,594, issued on Nov. 6, 2001; U.S. application Ser. No. 09/374,553, filed on Aug. 13, 1999 by inventor Vose; U.S. Pat. No. 6,098,342, issued to inventors Bischof, et al. on Aug. 8, 2000; U.S. Pat. No. 6,058,656, issued to inventors Bischof, et al. on May 9, 2000; U.S. Pat. No. 6,082,053, issued to inventors Bischof, et al. on Jul. 4, 2000; U.S. Pat. No. 6,073,673, issued to inventor Janutta on Jun. 13, 2000; U.S. Pat. No. 6,079,162, issued to inventor Hein on Jun. 27, 2000; U.S. patent application Ser. No. 09/026,460, filed on Feb. 19, 1998 by inventors Bischof, et al. now a U.S. Pat No. 6,286,258, issued on Sep. 11, 2001; U.S. patent application Ser. No. 08/898,216, filed on Jul. 22, 1997 by inventors Kordes, et al. now a U.S. Pat. No. 6,108,989, issued on Aug. 29, 2000; and U.S. Pat. No. 5,804,931, issued to inventor Schack on Sep. 8, 1998.

The corresponding foreign patent publication applications, namely, Federal Republic of Germany Patent Application No.199 37 362.0, filed on Aug. 12, 1999, having inventor Christian Hein, and DE-OS 199 37 362.0 and DE-PS 199 37 362.0, are hereby incorporated by reference as if set forth in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention as described hereinabove in the context of the preferred embodiments is not to be taken as limited to all of the provided details thereof, since modifications and variations thereof may be made without departing from the spirit and scope of the invention.

Index of Reference Symbols

1 Sliding panel
2 Sliding panel
3 Deflector
4 Drive belt
5 Stop
6 Stop
7 Locking element
8 Lever arm
9 Point of rotation or pin
10 Lever arm
11 Point of rotation or pin
12 Crank-type formation
13 Crank pin
14 Connecting part
15 Rounded portion
16 Recess
17 Ramp bevel
18 Lock pin
19 Lever (guide lever)
20 Slide surface
21 Direction of movement 'open'
22 Direction of movement 'closed'

What is claimed is:

1. A system for locking a powered sliding door, said system comprising:

an at least one sliding panel;

said at least one sliding panel having an opened and closed position to open and close a passageway;

a locking mechanism;

said locking mechanism being configured with a first portion and a second portion;

said locking mechanism being disposed adjacent said door to permit locking and unlocking of said at least one sliding panel;

said locking mechanism having an opened and closed position to lock and unlock said at least one sliding panel to thus open and close a passageway;

a device to retain said locking mechanism;

said retaining device being disposed to hold said second portion of said locking mechanism in the closed position of said locking mechanism;

said second portion of said locking mechanism element being disposed to operatively contact said at least one sliding panel;

said at least one sliding panel being openable and closable by opening and closing said locking mechanism;

a drive mechanism operatively connected to said at least one sliding panel to move said at least one sliding panel between its opened and closed position;

said drive mechanism being configured to interact with said second portion of said locking mechanism to move said locking mechanism into its opened and closed position in conformity with a direction of drive of said drive mechanism to thus permit moving of said at least one sliding panel to its opened and closed position;

at least two stops;

said at least two stops being disposed at a distance from one another and configured to interact with said second portion of said locking mechanism to lift said locking mechanism from said retaining device and thus to permit opening of said door in the absence of power for operating said drive mechanism;

said at least two stops being operatively connected to said at least one sliding panel;

a connecting element;

said connecting element being operatively connected to said drive mechanism;

said connecting element being configured to interact with said second portion of said locking mechanism to move said locking mechanism into its opened and closed position in conformity with a direction of drive of said drive mechanism and to bring said second portion of said locking mechanism into contact with at least one of said at least two stops;

said locking mechanism is configured as a substantially right-angle locking lever;

said locking lever comprising a vertex which is journalled for rotation at said at least one sliding panel;

said locking lever comprising a first lever arm and a second lever arm.

2. The system for locking according to claim 1 and further comprising:

a guide lever;

said guide lever being journalled for rotation at said at least one sliding panel; and a deflector;

said deflector being disposed to interact with said guide lever to ensure that said locking lever is securely brought into its closed position.

3. The system for locking according to claim 2 and further comprising:

a cam follower;

said cam follower being disposed at said locking element;

said guide lever comprising a cam formation configured to interact with said cam follower of said locking lever.

4. The system for locking according to claim 3 wherein said guide lever is configured with a slide surface at its end that is directed towards said deflector.

5. The system for locking according to claim 4 wherein said guide lever is a substantially planar member and its plane of movement is substantially adjacent to the interior surface of said locking lever.

6. The system for locking according to claim 5 wherein said at least one sliding panel comprises a first sliding pane and a second sliding panel;

said first and second sliding panels being movably disposed with respect to one another and adapted to converge to one another for closing a passageway and to separate from one another to open a passageway.

7. The system for locking according to claim 6 and further comprising:

an auxiliary drive;

said auxiliary drive being configured to permit to open said door upon failure of said drive mechanism.

8. The system for locking according to claim 7 wherein said first and second sliding panels comprise one of a), b), c), and d):

a) wood;

b) steel;

c) a light alloy metal; and d) glass.

9. The system for locking according to claim 3 wherein:

said cam formation comprises a crank-type formation; and said crank-type formation comprises a substantially rectangular slot.

10. The system for locking according to claim 1 wherein said locking lever is a substantially planar member.

11. A powered sliding door assembly having a system for locking the powered sliding door, said assembly comprising:

an at least one sliding panel;

said at least one sliding panel having an opened and a closed position;

a drive mechanism; said drive mechanism being configured to move said at least one sliding panel;

said drive mechanism being operatively connected to said at least one sliding door to move said at least one sliding panel between its opened and closed position;

an auxiliary drive mechanism;

said auxiliary drive mechanism being configured to permit to open said at least one sliding panel upon movement from its opened to its closed position upon failure of said drive mechanism;

said auxiliary drive mechanism being configured to stored energy upon movement of said at least one sliding panel from its opened to its closed position;

a locking mechanism;

said locking mechanism being mounted rotatably on a pivot;

said locking mechanism being configured with a first portion and a second portion;

said locking mechanism being disposed adjacent said door to permit locking and unlocking of said at least one sliding panel;

said locking mechanism having an opened and closed position to lock and unlock said at least one sliding panel by the action of said drive mechanism;

a device to retain said locking mechanism;

said retaining device being disposed to hold said second portion of said locking mechanism in the closed position of said locking mechanism;

said at least one sliding panel being openable and closable by opening and closing said locking mechanism;

at least one stop;

said at least one stop being operatively connected to said at least one sliding panel; and a connecting element;

said connecting element being operatively connected to said drive mechanism;

said connecting element being configured to interact with said second portion of said locking mechanism to move said locking mechanism into its opened and closed position in conformity with a direction of drive of said drive mechanism to thus permit moving of said at least one sliding panel to its opened and closed position;

said at least one stop being disposed and configured to interact with said second portion of said locking mechanism disengage said second portion of said locking mechanism from said retaining device upon failure of said drive mechanism and thus permit to open said door by hand in an emergency in coordination with said auxiliary drive mechanism;

said locking mechanism is configured as a substantially right-angle locking lever;

said locking lever comprising a vertex which is journalled for rotation at said at least one sliding panel;

said locking lever comprising a first lever arm configured to interact with said at least one stop and a second lever arm configured to interact with said retaining device.

12. A system for locking a powered sliding door, said system comprising:

an at least one sliding panel;

said at least one sliding panel having an opened and closed position to open an close a passageway;

a locking mechanism;

said locking mechanism being configured with a first portion and a second portion;

said locking mechanism being disposed adjacent said door to permit locking and unlocking of said at least one sliding panel;

said locking mechanism having an opened and closed position to lock and unlock said at least one sliding panel to thus open and close a passageway; and a device to retain said locking mechanism;

said retaining device being disposed to hold said second portion of said locking mechanism in the closed position of said locking mechanism;

said second portion of said locking mechanism element being disposed to operatively contact said at least one sliding panel;

said at least one sliding panel being openable and closable by opening and closing said locking mechanism;

a drive mechanism operatively connected to said at least one sliding panel to move said at least one sliding panel between its opened and closed position;

said drive mechanism being configured to interact with said second portion of said locking mechanism to move said locking mechanism into its opened and closed position in conformity with a direction of drive of said drive mechanism to thus permit moving of said at least one sliding panel to its opened and closed position;

said drive mechanism comprises a drive belt;

at least two stops;

said at least two stops being disposed at a distance from one another and configured to interact with said second portion of said locking mechanism to lift said locking mechanism from said retaining device and thus to permit opening of said door in the absence of power for operating said drive mechanism;

said at least two stops being operatively connected to said at least one sliding panel;

a connecting element;

said connecting element being operatively connected to said drive mechanism;

said connecting element being configured to interact with said second portion of said locking mechanism to move said locking mechanism into its opened and closed position in conformity with a direction of drive of said drive mechanism and to bring said second portion of said locking mechanism into contact with at least one of said at least two stops;

said locking mechanism being configured as a substantially right-angle locking lever;

said locking lever comprising a vertex which is journalled for rotation at said at least one sliding panel;

said locking lever comprising a first lever arm and a second lever arm;

a guide lever;

said guide lever being journal led for rotation at said at least one sliding panel; and a deflector;

said deflector being disposed to interact with said guide lever to ensure that said locking lever is securely brought into its closed position;

a cam follower;

said cam follower being disposed at said locking element;

said guide lever comprising a cam formation configured to interact with said cam follower of said locking lever;

said guide lever being configured with a slide surface at its end that is directed towards said deflector; and an auxiliary drive;

said auxiliary drive being configured to permit to manually open said door upon failure of said drive mechanism.

* * * * *

UNITED STATES PATENT AND TRADEMARK OFFICE

CERTIFICATE OF CORRECTION

PATENT NO. : 6,530,176 B1
DATED : March 11, 2003
INVENTOR(S) : Christian Hein

It is certified that error appears in the above-identified patent and that said Letters Patent is hereby corrected as shown below:

Column 1,
Line 11, after the first occurrence of “a”, delete “first,end” and insert -- first end --.

Column 3,
Line 29, after "with", delete “a-ramp” and insert -- a ramp --.

Column 13,
Line 27, after “mechanism;” begin a new paragraph with “said”.
Line 38, after “to”, delete “stored” and insert -- store --.

Signed and Sealed this

First Day of July, 2003

JAMES E. ROGAN
*Director of the United States Patent and Trademark Office*